US009243516B2

(12) United States Patent
Roge et al.

(10) Patent No.: US 9,243,516 B2
(45) Date of Patent: Jan. 26, 2016

(54) EXHAUST DEVICE FOR A STEAM TURBINE MODULE

(75) Inventors: Julien Roge, Clichy (FR); Xavier Laurent, Villepinte (FR)

(73) Assignee: ALSTOM TECHNOLOGY LTD, Baden (CH)

( * ) Notice: Subject to any disclaimer, the term of this patent is extended or adjusted under 35 U.S.C. 154(b) by 836 days.

(21) Appl. No.: 13/371,603

(22) Filed: Feb. 13, 2012

(65) Prior Publication Data

US 2012/0207595 A1 Aug. 16, 2012

(30) Foreign Application Priority Data

Feb. 11, 2011 (FR) ..... 11 51134

(51) Int. Cl.
*F01D 25/28* (2006.01)
*F01D 25/30* (2006.01)
*F01D 25/16* (2006.01)

(52) U.S. Cl.
CPC ..... *F01D 25/30* (2013.01); *F01D 25/16* (2013.01); *F01D 25/28* (2013.01); *F05D 2220/31* (2013.01); *F05D 2260/30* (2013.01)

(58) Field of Classification Search
CPC ..... F01D 25/30; F01D 25/28; F01D 25/16; F05D 2260/30; F05D 2220/31
USPC ..... 415/207, 208.1, 209.1–209.4, 211.2, 415/224.5
See application file for complete search history.

(56) References Cited

U.S. PATENT DOCUMENTS 3,773,431 A * 11/1973 Bellati et al. ..... 415/108
4,013,378 A * 3/1977 Herzog ..... F01D 25/30 415/208.2
4,391,564 A * 7/1983 Garkusha ..... F01D 25/30 415/126
5,149,248 A 9/1992 Cramer
5,588,799 A * 12/1996 Kreitmeier ..... F01D 25/30 415/207
5,707,208 A * 1/1998 Kreitmeier ..... F01D 25/30 415/207
6,135,707 A * 10/2000 Endries ..... F01K 13/025 415/1
6,533,546 B2 * 3/2003 Kreitmeier ..... F01D 25/30 415/211.2

(Continued)

FOREIGN PATENT DOCUMENTS

CN 1944962 A 4/2007
CN 101255802 A 9/2008

(Continued)

OTHER PUBLICATIONS

French Patent Office, Examination Report in French Patent Application No. 11/51134 (Aug. 15, 2011).

(Continued)

*Primary Examiner* — Nathaniel Wiehe
*Assistant Examiner* — Eldon Brockman
(74) *Attorney, Agent, or Firm* — Buchanan Ingersoll & Rooney PC

(57) ABSTRACT

A steam exhaust device for a steam turbine module includes a steam exhaust duct having a steam diffuser and a steam exhaust bottom wall, the steam exhaust duct being delimited by a surface of the steam diffuser configured to guide steam and by a steam exhaust bottom wall. A rigid hub includes one of a circular and a semicircular shape, the steam diffuser being rigidly fixed on the rigid hub. A rigid fastening device is fixed on the rigid hub and configured to support the steam exhaust device on a rigid frame.

13 Claims, 6 Drawing Sheets

(56) References Cited

U.S. PATENT DOCUMENTS

| | | | | |
|---|---|---|---|---|
| 8,668,450 | B2 * | 3/2014 | Chevrette | 415/211.2 |
| 2002/0127100 | A1 * | 9/2002 | Kreitmeier | F01D 25/30 415/211.2 |
| 2007/0081892 | A1 * | 4/2007 | Sharrow | F01D 25/28 415/211.2 |
| 2008/0213091 | A1 | 9/2008 | Lageder et al. | |
| 2010/0162705 | A1 * | 7/2010 | Sharrow | F01D 25/30 60/697 |
| 2010/0269480 | A1 * | 10/2010 | Lindenfeld | F01D 25/30 60/39.5 |
| 2012/0207595 | A1 | 8/2012 | Roge et al. | |

FOREIGN PATENT DOCUMENTS

| | | | |
|---|---|---|---|
| CN | 202065017 | U | 12/2011 |
| DE | 2200447 | A1 | 12/1972 |
| JP | 63097805 | A | 4/1988 |
| RU | 2117773 | C1 | 8/1998 |
| SU | 1605003 | A1 | 7/1990 |

OTHER PUBLICATIONS

Office Action/Search Report issued on Aug. 26, 2014, by the Chinese Patent Office in corresponding Chinese Patent Application No. 201110103917.0 and an English translation of Office Action/Search Report. (19 pages).

Office Action issued on Aug. 25, 2014, by the Russian Patent Office in corresponding Russian Patent Application No. 2012104813 and an English Translation of the Office Action. (9 pages).

Decision of Grant issued Mar. 11, 2015, by the Russian Patent Office in corresponding Russian Patent Application No. 2012104813, and an English translation thereof (11 pages).

* cited by examiner

EXHAUST DEVICE FOR A STEAM TURBINE MODULE

CROSS REFERENCE TO PRIOR APPLICATIONS

Priority is claimed to French Patent Application No. FR 11/51134, filed on Feb. 11, 2011, the entire disclosure of which is hereby incorporated by reference herein.

FIELD

The present invention relates to the field of steam turbines.

BACKGROUND

Steam turbines are for example used in electric power production installations, wherein the turbine drives a generator which generates the electric power. Such installations may operate with fossil or non-conventional energy.

SUMMARY OF THE INVENTION

In an embodiment, the present invention provides a steam exhaust device for a steam turbine module. The device includes a steam exhaust duct having a steam diffuser and a steam exhaust bottom wall, the steam exhaust duct being delimited by a surface of the steam diffuser configured to guide steam and by a steam exhaust bottom wall. A rigid hub includes one of a circular and a semicircular shape, the steam diffuser being rigidly fixed on the rigid hub. A rigid fastening device is fixed on the rigid hub and configured to support the steam exhaust device on a rigid frame.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

An aspect of the invention is to provide an exhaust device for a steam turbine, an internal structure and a steam turbine module. Another aspect is to provide a diffuser for such a turbine.

Figure 1:
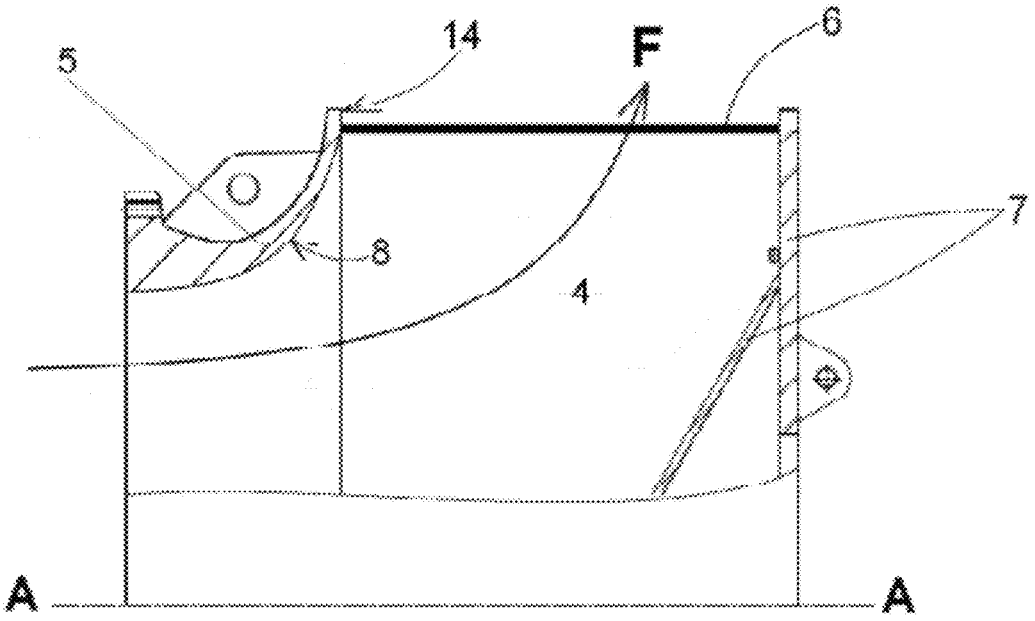
Prior Art Figure 1
FIG. 1 represents an earlier exhaust device as developed by the applicant.

FIG. 1 shows an earlier exhaust device issued from the applicant. In the figure, a direction of a steam flow is illustrated by the arrow F. The flow is guided by a surface 8 of a steam diffuser and a steam exhaust bottom wall 7. The guiding surface 8 of steam diffuser 5 has the shape of a revolution surface diverging around an axis of revolution AA which corresponds to the axis of revolution of the rotor of the turbine. Traditionally such a steam diffuser is manufactured by molding in a foundry. The particularly bulky form of steam diffuser 5 is to be noted. This bulky form is necessary to ensure the overall mechanical resistance of the assembly formed by the internal body 15 and the steam exhaust device. Indeed, steam diffuser 5 is directly connected to the steam exhaust bottom wall 7 by an end 14 located on one side of a steam exhaust 4 by a fastening device 6. By its end opposed to the steam exhaust 4 the steam diffuser carries the internal body of the turbine module. Consequently the steam diffuser must be dimensioned sufficient to support its own weight as well as to impart the load between the steam exhaust device and the internal body.

An embodiment of the invention provides a solution to achieve a steam exhaust device, an internal structure and a simpler steam turbine module by improving the mechanical properties. Finding an embodiment different from the prior art is not easy because the parts have significant dimensions and weights (a diameter of several meters) and undergo high thermal, mechanical and vibratory stresses.

According to a first feature in an embodiment of the invention, the exhaust device exhibits a steam exhaust duct provided with a steam diffuser. The steam exhaust duct is delimited by:

a surface of a steam diffuser adapted for guiding a steam flow, and a steam exhaust bottom wall.

In an embodiment, the steam exhaust device includes a circular or semicircular rigid hub on which the steam diffuser is fixed.

In an embodiment, on the hub is fixed a rigid fastening device intended to have the exhaust device supported on a rigid frame. The advantages obtained through such a solution relate to the simplicity of realization and the improvement of the mechanical resistance.

According to a particular feature in an embodiment, the rigid fastening device comprises a set of rigid rods extending through the steam exhaust duct. One end of the rods is mounted on the hub. This feature allows a simple implementation and a good behavior of the fastening device within the hub.

According to another particular feature in an embodiment, another end of the rods is fixed on the exhaust bottom wall, for being supported by said rigid frame. Thus, a direct mechanical connection between the rigid frame and the hub is obtained.

According to another feature in an embodiment there is an internal structure of a steam turbine module, comprising a steam exhaust device as above described and exhibiting an internal body adapted for receiving a rotor of the turbine. The internal body is supported on either side by the steam hub. This feature allows both a simple and stable assembly of the internal body without resorting to the diffuser.

According to another aspect of the invention, there is a steam turbine module comprising an internal body adapted for receiving the rotor of the low pressure module of the turbine. The internal body is supported on either side by the hub of the exhaust device and, the exhaust device has support means for supporting the internal body on a rigid frame.

According to a preferred feature in an embodiment, the support means is fixed on the steam exhaust bottom wall. Thus, continuous mechanical connection between the fastening device, the hub and the internal body is obtained.

According to another preferred feature in an embodiment, the support means also carries a bearing supporting rotation of said rotor.

The above features make it possible to establish the relative position between the rotor and the internal body since they are supported by the same part.

According to another feature in an embodiment, the exhaust device, the internal structure or the turbine module comprises a steam diffuser having a steam guiding surface. The steam guiding surface has a widening rotational shape around a revolution axis, and includes several plate portions welded to one another. The steam diffuser is assembled on the hub. As a consequence, since the diffuser is no longer participating in the overall mechanical resistance of the internal body unit/exhaust device assembly, it may be considerably reduced in weight. In addition, the manufacturing process makes it possible to easily adapt the construction of said steam diffuser in order to modify the eigenfrequencies of the assembly including the internal body and the steam exhaust device. Thus such an assembly is not to be likely to enter in resonance with the frequencies of the steam network, for example, by choosing the dimensions and thicknesses of the plate portions provided on the diffuser, together with the length of the rods connected to said diffuser.

Figure 2:
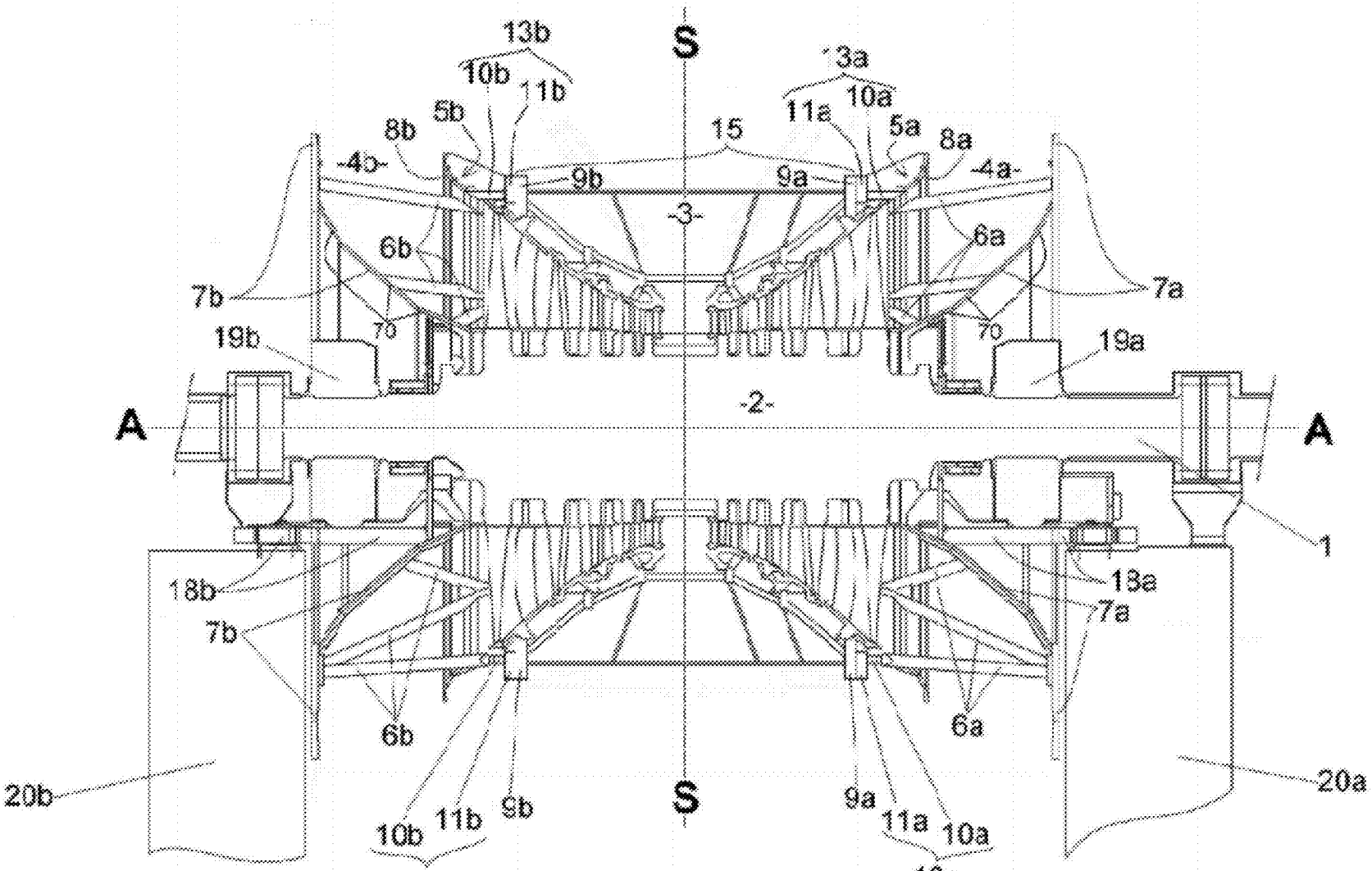
FIG. 2 represents a steam turbine module according to an embodiment of the invention along an axial section.

FIG. 2 represents a low pressure steam turbine module having a symmetrical construction with respect to the symmetry plane S perpendicular to the turbine revolution axis AA. The identical parts located on either side of this symmetry plane S have the same reference number with an a or b index. The module has a shaft 1 provided with a rotor 2. The rotor carries a series of vaned wheels, here two series of five wheels defining as many stages for steam expansion. The number of wheels can vary according to the size of the machine. Shaft 1 rotates according to the revolution axis AA. Steam intake 3 is located at the center of rotor 2 between the two series of wheels. The steam exhaust duct 4*a*, 4*b* is located on either side of intake 3. The wheel assembly rotates inside a fixed internal body 15. Internal body 15 bears two series of fixed bladings.

Each one of the fixed bladings is arranged in the vicinity of one vaned wheel.

At each one end thereof located on the exhaust 4*a*, 4*b* side, internal body 15 receives a steam diffuser 5*a*, 5*b*. Each steam diffuser 5*a*, 5*b* is positioned immediately after the output of the last vaned wheel, namely the vaned wheel having the largest diameter. Surface 8*a*, 8*b* of the steam diffuser in contact with the steam has the shape of a diverging steam diffuser in order to slow down the flow rate of the steam and allow rotor 2 to recover the kinetic energy of the steam. Thus, the efficiency of the last stage of the turbine is maximized. The shape of (each) surface 8*a*, 8*b* is diverging, i.e. the passage section of the diffuser increases gradually towards steam exhaust 4*a*, 4*b*. Each steam diffuser 5*a*, 5*b* is fixed to the internal body 15 by circular or semicircular flanges 9*a*, 9*b*, 11*a*, 11*b* belonging respectively to the internal body 15 and diffuser 5*a*, 5*b*. Each steam diffuser 5*a*, 5*b* is supported by a rigid fastening device 6*a*, 6*b* for fastening to a steam exhaust bottom wall 7*a*, 7*b* guiding the steam in the steam exhaust duct 4*a*, 4*b*. Each wall 7*a*, 7*b* is supported by a rigid frame 20*a*, 20*b*, such as a foundation. The rigid frame 20*a*, 20*b* is disposed outside the exhaust device and also preferably outside the turbine module.

Each diffuser 5*a*, 5*b* is assembled and fixed on a respective skirt 10*a*, 10*b* integral with a respective flange 11*a*, 11*b* of the diffuser. Respective skirts 10*a*, 10*b* and flanges 11*a*, 11*b* are welded to one another so as to form a rigid hub 13*a*, 13*b*. The hub 13*a*, 13*b* has a circular, preferably semicircular, annular form (see FIGS. 4 and 6) to facilitate construction and assembly. The rigid fastening device 6*a*, 6*b* is directly implemented in the hub 13*a*, 13*b*. The rigid fastening device 6*a*, 6*b* comprises a set of rigid rods. The rigid rods 6*a*, 6*b* are fixed, preferably by welding, at one end thereof to the hub 13*a*, 13*b* and at the opposite end thereof to the exhaust bottom wall 7*a*, 7*b*. Wall 7*a*, 7*b* has a conical part 70, including several cone sections, extended at its periphery by an annular planar part on which are fixed the rigid rods 6*a*, 6*b*. A support means comprising a support plate 18*a*, 18*b* is fixed to the conical part 70 and bears on the rigid frame 20*a*, 20*b*. The fixing of the rods 6*a*, 6*b* to the hub 13*a*, 13*b* may be improved by inserting the rods in drillings or recesses 21 achieved in the thickness of the hub skirt (that can be seen in the upper part of FIG. 4). Each plate support 18*a*, 18*b* carries a bearing 19*a*, 19*b* supporting the rotation of rotor 2.

Figure 4:
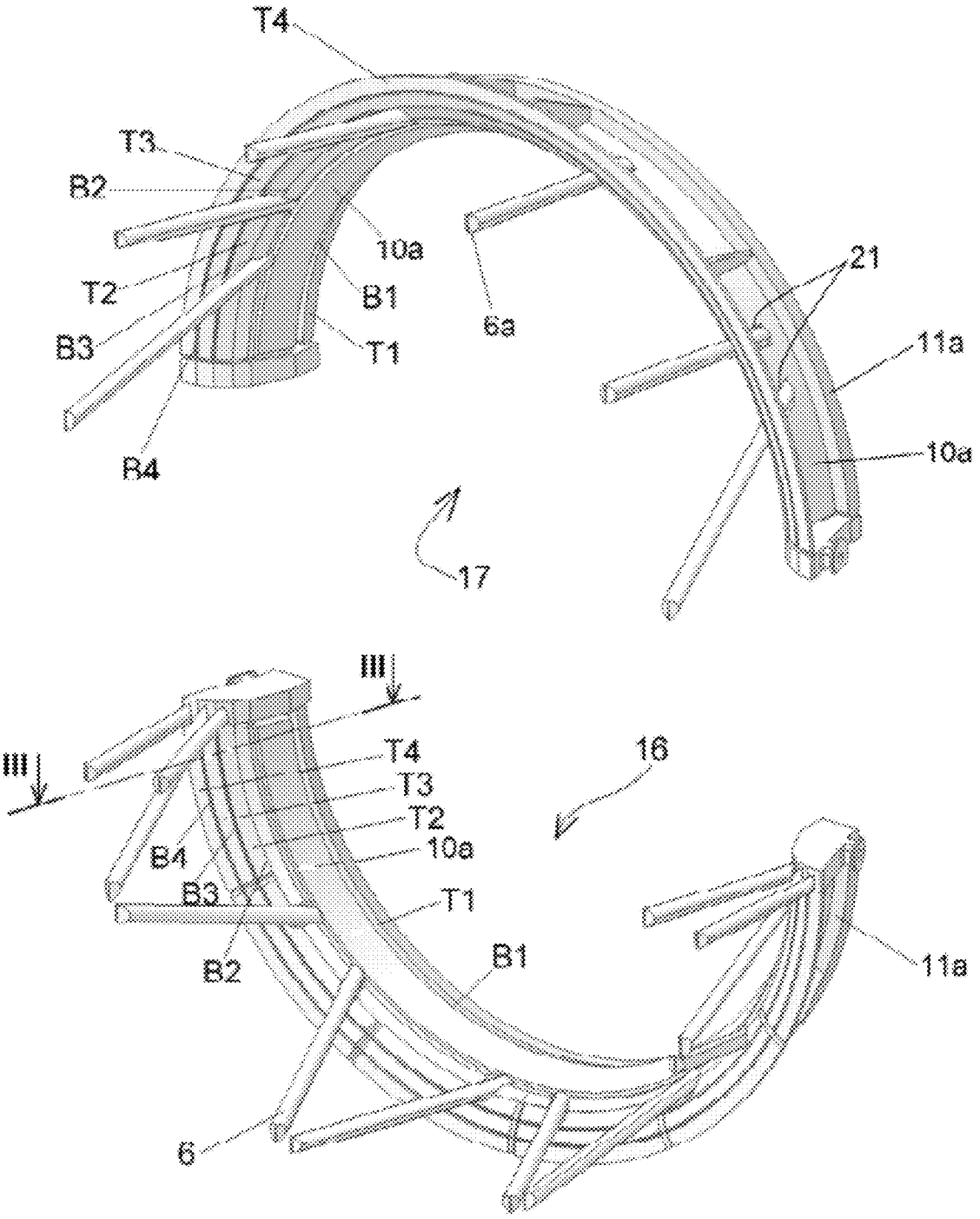
FIG. 4 shows a perspective view of the diffuser and the fastening device according to the first embodiment.

The subassembly formed by the support plate 18*a*, 18*b*, the exhaust bottom wall 7*a*, 7*b*, the rigid fastening device 6*a*, 6*b*, the hub 13*a*, 13*b* and the steam diffuser 5*a*, 5*b* constitutes the steam exhaust device. Advantageously this steam exhaust device may exhibit a pre-assembled shape before its assembly in the turbine module. In order to facilitate construction and assembly, the exhaust device will comprise two half subassemblies such as illustrated in FIG. 4. Both subassemblies are connected together at the joint plane of the turbine module.

The assembly formed by the internal body 15, fixed on either side, by flanges 9*a*, 9*b*, 11*a*, 11*b*, to two exhaust devices constitutes the internal structure of the turbine module. Thus, internal body 15 is intercalated between, and supported by two steam exhaust devices. The rigid frame 20*a*, 20*b* carries this internal structure, on either side, through the support plates 18*a*, 18*b*. The rigid frame 20*a*, 20*b* also carries rotor 2 through bearings 19*a*, 19*b* fixed on support plates 18*a*, 18*b*.

The whole rigid rods 6*a*, 6*b* are rigidly and directly fixed to hub 13 and to the exhaust bottom wall 7*a*, 7*b* which is supported by the rigid frame 20*a*, 20*b*. The internal body 15 is rigidly fixed to hub 13. Thus, hub 13*a*, 13*b* is rigidly connected to the rigid frame 20*a*, 20*b* by the rigid fastening device 6*a*, 6*b*. Hub steadily supports, on one hand, the internal body 15 and, on the other hand, the parts forming the diffuser 5*a*, 5*b* which becomes a device of the internal structure which no longer participates in the overall mechanical resistance. Hub 13*a*, 13*b* directly connects internal body 15 to the rigid fastening device 6*a*, 6*b* without passing by diffuser 5*a*, 5*b*. Thus, diffuser 5 represented in FIG. 1 has no longer to support (by its end 14) neither the weight of diffuser 5, nor the weight internal body. As a result, diffuser 5 can be considerably reduced in weight and be made in a much simpler fashion than in prior art, for example as molded parts assembled on the hub, but preferably as mechanically welded parts, as exposed hereafter. A mechanical welding is particularly adapted to the construction described above since, on one hand, the weight is notably decreased, which will make it possible to reduce the overall weight of the machine while ensuring its mechanical resistance, and, on the other hand, the adjustment of the eigenfrequencies of the internal structure is facilitated. The risks of vibrations are reduced.

Preferably, the diffuser is made from several portions of plates shaped beforehand by cold working then assembled by welding so as to obtain the diverging revolution surface 8*a* of diffuser 5*a*, 5*b*. The diffuser 5*a*, 5*b* is assembled on the hub 13*a*, 13*b*.

Figure 3:
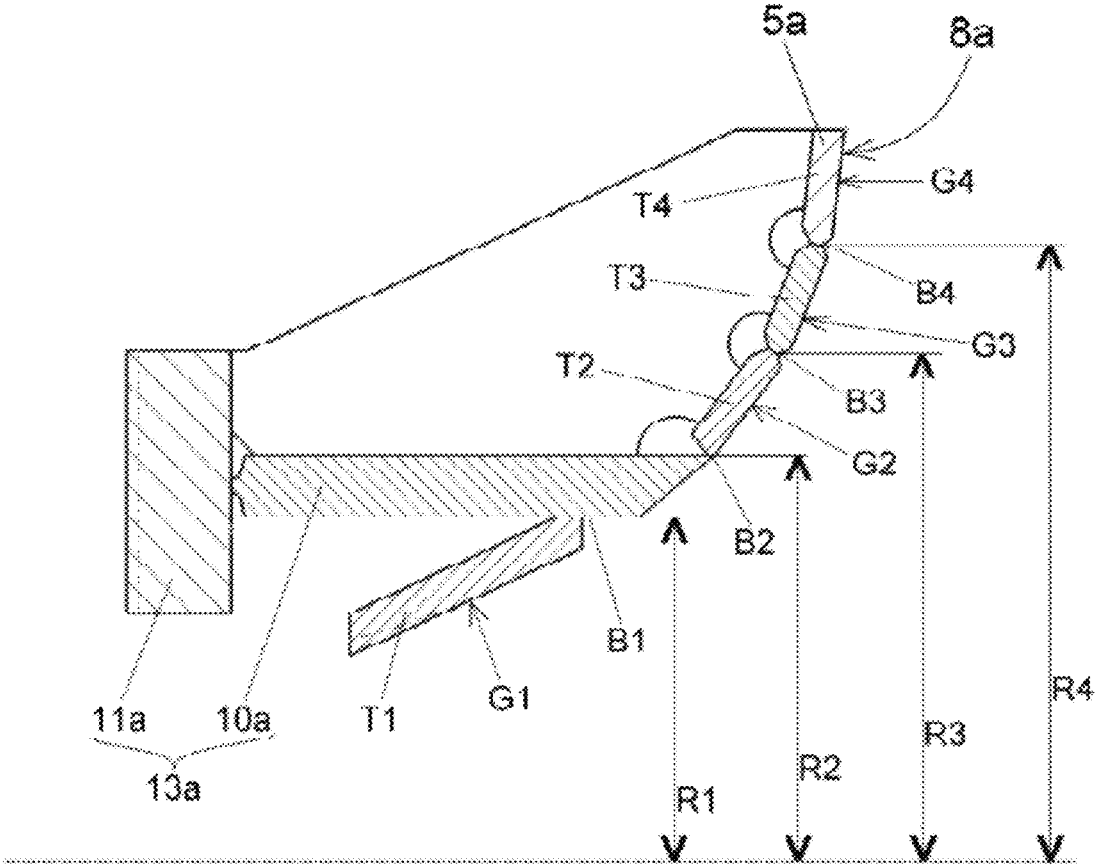
FIG. 3 is a section along III-III of FIG. 4 illustrating a first embodiment of the diffuser.

FIGS. 3 and 4 illustrate a first embodiment. The diffuser comprises a lower half-part 16 illustrated on FIG. 4 on which an upper half-part 17 similar to lower half-part 16 is mounted. The diffuser 5*a* has a semicircular flange 11*a* on which is fixed a skirt 10*a*, also semicircular. The overall assembly forms a semicircular annular rigid hub 13*a*. On FIG. 3 four plate portions T1, T2, T3, T4 are shown. Each plate portion is made from a strip cut out beforehand in a metal plate. Each strip is then shaped by rolling so as to obtain annular shaped sections T1, T2, T3, T4. What is meant by "section" is an arc-shaped portion of a circular ring, here conical. Each annular section T1, T2, T3, T4 has an edge B1, B2, B3, B4 running on a constant radius R1, R2, R3, R4 from the revolution axis AA. Section T1 is welded onto skirt 10*a* along edge B1. Section T2 is welded onto skirt 10*a* along edge B2 and section T3 along edge B3. Section T3 is welded with section T4 along edge B4. FIG. 4 shows that six groups of four sections T1, T2, T3, T4 are used to form the lower half-part 16 of diffuser 5. Seams are also carried out between the ends of each group of sections. The upper half-part 17 is formed in a similar way, each annular section T1, T2, T3, T4 being manufactured here in a single part spanning all the periphery of upper half-part 17. Thus, the diffuser 5*a* exhibits, extending in the direction of axis A, a succession of several annular, here conical, sections T2, T3, T4, welded to one another onto respective elongated edges B3, B4. The number of sections used may vary as need be. In practice, the upper and lower half-parts 17 and 16 will preferably be made on the same fashion.

Each annular section T1, T2, T3, T4 exhibits a generating line G1, G2, G3, G4 whose rotation around revolution axis AA generates part of the shape of the diverging revolution surface 8*a*: in this first embodiment each generating line is a segment of a straight line inclined with respect to axis AA. The assembly of the various sections makes it possible to obtain a surface 8*a* approaching the form of a surface of the diffuser allowing the expansion of steam. During rolling, rollers having straight generating lines will be used, so as to obtain conical sections.

Figure 5:
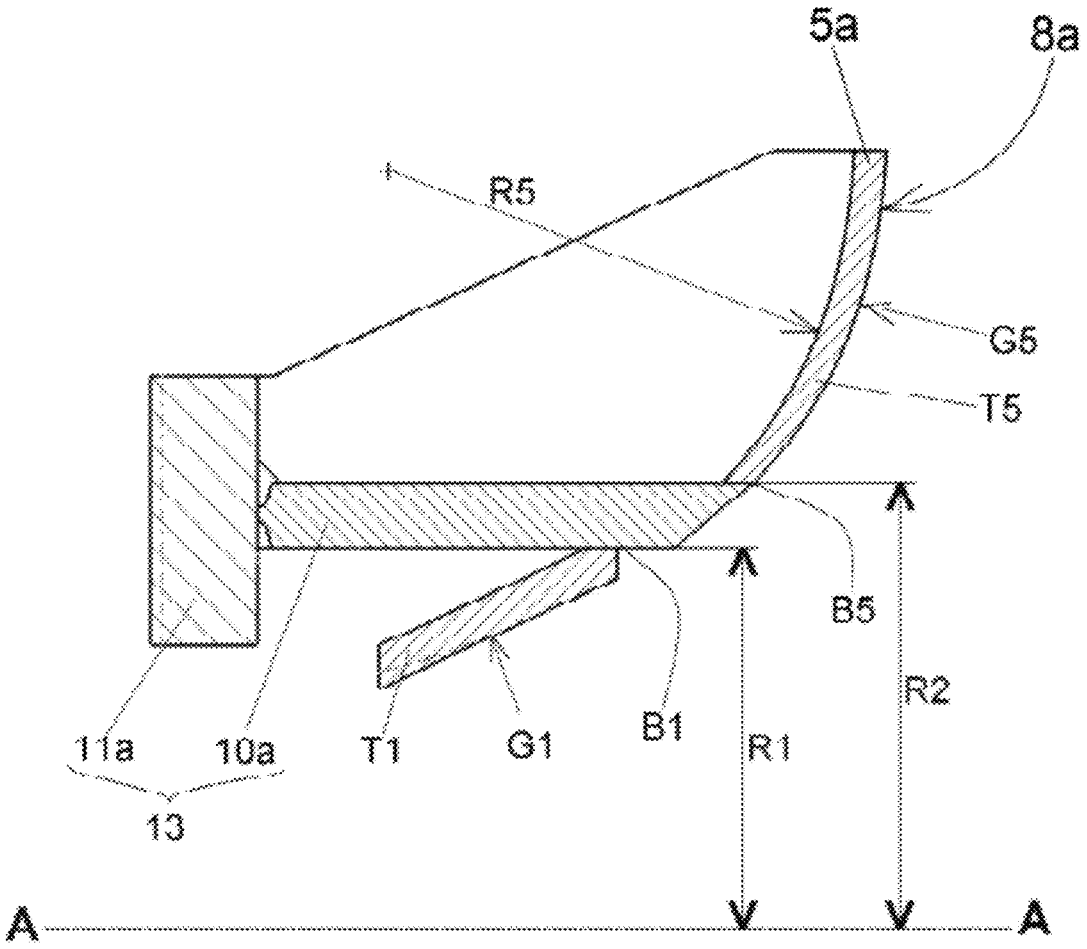
FIG. 5 is a section along V-V of FIG. 6 illustrating a second embodiment of the diffuser.
Figure 6:
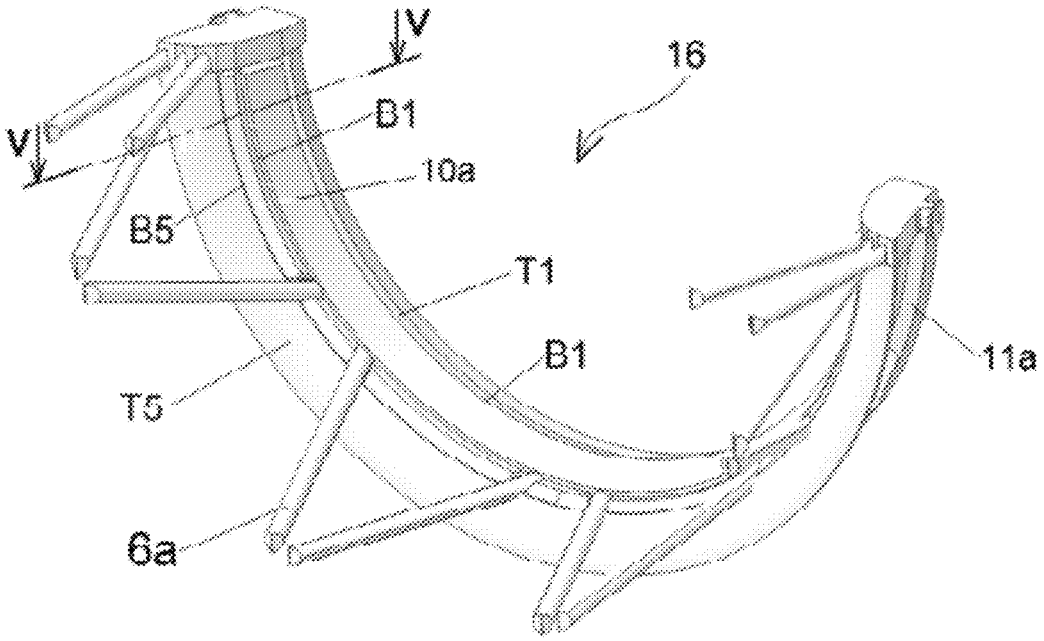
FIG. 6 represents a perspective view of the diffuser and the fastening device according to the second embodiment.

FIGS. 5 and 6 illustrate a second embodiment. The description of parts already described in relation to FIGS. 3 and 4 is omitted below.

Herein, the annular sections T2, T3, T4 of the first embodiment are replaced by a single annular section T5 which is welded over the length of the elongated edge B5 thereof extending on radius R2 to the skirt 10*a*. The annular section T5 has a curved generating line G5. The curvature makes it possible to obtain the diffuser surface 8*a*. The curve shape has a curvature radius R5 illustrated on FIG. 5. This curvature is obtained by rolling convex and/or concave rollers having curvatures corresponding to the form of the surface 8*a* to be obtained.

It is to be noted that between sections T1 and T5, revolution surface 8*a* is obtained by shaping the skirt end 10*a*, for example, by machining. The same feature is present in the first embodiment between the sections T1 and T2.

On FIG. 6 only one section T5 is used to form the lower half-part 16 of the diffuser 5*a*. Several sections can be used if need be.

The solutions described above make it possible to obtain the following advantages:

- a weight reduction of about 30% of the exhaust device,
- an exhaust device having a more resistant internal structure owing to the fact that the diffuser no longer participates in the overall mechanical resistance,
- the manufacturing process makes it possible to easily adapt the construction so as to adjust the Eigen frequencies of the internal body-exhaust device assembly and thus avoid the risk of resonance with the frequencies of the network. To this end, selecting the dimensions and thicknesses of the plate portions intended for the diffuser is only a matter of choice,
- the cost of the obtained assembly is lower than that of a molded diffuser.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

What is claimed is:

1. A steam exhaust device for a steam turbine module comprising:

a steam exhaust duct including a steam diffuser having a radially outer flow guide surface; and a steam exhaust bottom wall, the steam exhaust duct being delimited by the radially outer flow guide surface of the steam diffuser and by the steam exhaust bottom wall;

a rigid hub including one of a circular and a semicircular shape, the radially outer flow guide surface of the steam diffuser being rigidly fixed on the rigid hub and the rigid hub forming a portion of the radially outer flow guide surface of the diffuser; and a rigid fastening device comprising a plurality of rods extending through the steam exhaust duct and fixed to the portion of the of the radially outer flow guide surface of the diffuser formed by the rigid hub and configured to support the steam exhaust device on a rigid frame, wherein the rigid hub directly connects an internal body to the plurality of rods without the plurality of rods passing through the radially outer flow guide surface of the steam diffuser.

2. The steam exhaust device as recited in claim 1, wherein a first end of each of the plurality of rigid rods is attached to the rigid hub.

3. The exhaust device as recited in claim 2, wherein a second end of each of the plurality of rods is fixed to the steam exhaust bottom wall so as to be supported by the rigid frame.

4. The exhaust device as recited in claim 1, wherein the radially outer flow guide surface of the steam diffuser includes a revolution surface diverging around a revolution axis and a plurality of plate portions shaped and welded to one another and disposed on the rigid hub.

5. The exhaust device as recited in claim 4, wherein each of the plurality of plate portions includes an annular-shaped section having an edge running on a constant radius of the revolution axis.

6. An internal structure for a steam turbine module comprising:

a steam exhaust device including a steam exhaust duct including a steam diffuser having a radially outer flow guide surface;

a steam exhaust bottom wall, the steam exhaust duct being delimited by the radially outer flow guide surface and by the steam exhaust bottom wall;

a rigid hub including one of a circular and a semicircular shape, the steam diffuser radially outer flow guide surface being rigidly fixed on the rigid hub and the rigid hub forming a portion of the radially outer flow guide surface of the diffuser;

a rigid fastening device comprising a plurality of rods extending through the steam exhaust duct and fixed on the rigid hub and configured to support the steam exhaust device on a rigid frame; and an internal body configured to receive a turbine rotor and be supported on a side by the rigid hub, wherein the rigid hub directly connects the internal body to the plurality of rods without the plurality of rods passing through the steam diffuser.

7. The internal structure as recited in claim 6, wherein the radially outer flow guide surface of the steam diffuser includes a revolution surface diverging around a revolution axis and a plurality of plate portions shaped and welded to one another and disposed on the rigid hub.

8. The exhaust device as recited in claim 7, wherein each of the plurality of plate portions includes an annular-shaped section having an edge running on a constant radius of the revolution axis.

9. A steam turbine module comprising: a rigid frame;

an internal body configured to receive a turbine rotor;

a steam exhaust device including a steam exhaust duct including:

a steam diffuser having a radially outer flow guide surface;

a steam exhaust bottom wall, the steam exhaust duct being delimited by the radially outer flow guide surface of the steam diffuser and by the steam exhaust bottom wall;

a rigid hub including one of a circular and a semicircular shape, the steam diffuser radially outer flow guide surface being rigidly fixed on the rigid hub and the rigid hub forming a portion of the radially outer flow guide surface of the diffuser;

a rigid fastening device comprising a plurality of rods extending through the steam exhaust duct and fixed on the rigid hub and configured to support the steam exhaust device on a rigid frame; and a support device configured to support the internal body on the rigid frame, wherein the rigid hub directly connects the internal body to the plurality of rods without the plurality of rods passing through the steam diffuser radially outer flow guide surface.

10. The steam turbine module as recited in claim 9, wherein the support device is fixed on the steam exhaust bottom wall.

11. The steam turbine module as recited in claim 10, wherein the support device includes a bearing configured to support a rotation of the turbine rotor.

12. The steam turbine module as recited in claim 9, wherein the radially outer flow guide surface of the steam diffuser includes a form of a revolution surface diverging around a revolution axis and a plurality of plate portions shaped and welded to one another and disposed on the rigid hub.

13. The steam turbine module as recited in claim 12, wherein each of the plurality of plate portions includes an annular-shaped section having an edge running on a constant radius of the revolution axis.

* * * * *